United States Patent [19]

Perrella et al.

[11] Patent Number: 4,637,451

[45] Date of Patent: Jan. 20, 1987

[54] DIE CASTING MOLD

[75] Inventors: Guido Perrella, Westmount, Canada; William E. Thompson, Middletown, Ind.

[73] Assignee: DBM Industries Limited, Quebec, Canada

[21] Appl. No.: 582,632

[22] Filed: Feb. 22, 1984

[51] Int. Cl.[4] ..... B22D 17/26

[52] U.S. Cl. ..... 164/342; 164/306; 164/348; 249/135

[58] Field of Search ..... 164/325, 341, 348, 303, 164/305, 306, 312; 249/135

[56] References Cited

U.S. PATENT DOCUMENTS

| | | | |
|---|---|---|---|
| 473,382 | 4/1892 | Clark . | |
| 1,556,642 | 10/1925 | Smith . | |
| 2,134,829 | 11/1938 | McWane . | |
| 2,295,858 | 9/1942 | McWane . | |
| 2,313,004 | 3/1943 | Pritchard | 164/342 |
| 2,313,253 | 3/1943 | McWane . | |
| 2,387,803 | 10/1945 | McWane . | |
| 3,454,988 | 7/1969 | Cremer . | |
| 3,760,864 | 9/1973 | Kirby . | |
| 3,921,707 | 11/1975 | Killion et al. | 164/305 |

FOREIGN PATENT DOCUMENTS

| | | | |
|---|---|---|---|
| 2411673 | 3/1974 | Fed. Rep. of Germany | 164/348 |

*Primary Examiner*—W. D. Bray
*Attorney, Agent, or Firm*—James W. Hellwege

[57] ABSTRACT

A die casting metal hald mold comprising a front wall incorporating a die casting area, side walls extending rearwardly from the front wall, a backing member closing the base of said side walls, means to fasten the backing member to the bottom of said side walls, the front wall, side walls and backing member forming a high pressure heat exchange cavity, a valve for introducing fluid under pressure into said high pressure heat exchange cavity and a valve for releasing gas under pressure from said high pressure heat exchange cavity.

7 Claims, 2 Drawing Figures

DIE CASTING MOLD

This invention relates to die casting molds made of mold halves each of which has a high pressure heat exchange cavity. The die casting half molds of this invention have a thin wall between the die casting area of the half mold and the high pressure heat exchange cavity. The thin wall between the die casting area and the high pressure heat exchange cavity covers substantially the whole surface area between the die casting area and the high pressure heat exchange cavity.

A high pressure heat exchange cavity enables the heat exchange medium in the high pressure heat exchange cavity to be maintained as a liquid at a high temperature relative to the temperature at which the metal being cast in the mold is introduced in the mold. A die casting half mold having a thin wall of large surface area between the die casting area of the half mold and the high pressure heat exchange cavity was created to take advantage of the relatively lower temperature differential between the metal being cast and the heat exchange medium for removing the heat obtained by utilizing a relatively high temperature heat exchange medium.

Die casting molds currently in use utilize water at atmospheric pressure as the heat exchange medium to remove heat from the die cavity. Heat exchange is achieved by drilling a series of conduits through the die block which enables water to be circulated through the die block and thus cool the die cavity. As the systems in use to exchange heat from the die cavity are not pressurized, sufficient cool water must be circulated through the die block to sufficiently cool the die cavity so that the cast metal may be shot into the die cavity, cooled, solidified and removed. The temperature of the hot metal introduced into the die cavity varies from metal to metal. Zinc is usually introduced into molds at about 800° Farenheit while aluminium is introduced into molds at about 1200° Farenheit, while the temperature of the circulating water is normally between 70° and 200° Farenheit. The resultant temperature differential between the hottest and coldest parts of a conventional mold when casting zinc and aluminium respectively is about 600° and 1000° Farenheit.

The heat exchange conduits of conventional molds are normally spaced at least several inches away from the die casting cavity and several inches away from each other so that the steel between the heat exchange conduits and the die cavity will disseminate the cooling effect of the cold water flowing through the heat exchange conduits before the cooling effect reaches the die cavity. The greater the thickness of steel between the die casting cavity and the heat exchange conduits in conventional molds, the more even will be the temperature profile across the die casting cavity. On the other hand, the greater the thickness of steel between the heat exchange conduits and the die cavity the slower will heat exchange take place.

If the heat transfer conduits of conventional molds are placed close to the die cavity there is an increased possibility of thermal fatigue occurring in the mold because of the substantial temperature differential occurring over a narrow thickness. A further disadvantage of placing conventional heat transfer conduits in close proximity to the die cavity is the creation of temperature distortions caused by wide temperature differentials between those areas of the die cavity most proximate to the heat transfer conduits and those areas of the die cavity furthermost from the die casting.

With a die casting mold having a pressurized heat exchange cavity, it is possible to raise the temperature of the heat exchange medium to any desired temperature up to 500° Farenheit. For example, the pressure in the heat exchange cavity is preferably maintained at a point such that the boiling point of the heat exchange medium ranges from 270° to 500° Farenheit. The temperature differential between the die cavity and the high pressure heat exchange cavity across the die casting area of the front wall is substantially less than that found with molds cooled by water running through conduits in the mold. The lower temperature differential has resulted in the manufacture of a mold having a die cast wall with a thickness as thin as three-tenths of an inch depending on the dimension of the casting and the heat to be removed therefrom. The die casting area generally includes all that part of the front wall which receives the hot casting material.

The lower heat differential between the die cavity and the high pressure heat exchange cavity has also made it possible to increase the surface area of the high pressure heat exchange cavity in contact with the die cast area of the front wall. The surface area of the thin wall is the die casting area of the front wall receiving hot liquid.

With the increased surface area of the high pressure heat exchange cavity in contact with the die casting area of the mold, it is possible to obtain both a larger heat exchange surface and an improved temperature profile on the die casting area of the mold.

Pieces which are to be cast in die casting molds have an endless variety of shapes and thickness. The amount of hot metal to be cooled increases with the thickness of piece to be cast, decreases with the thinness of the piece to be cast and is directly related to the surface area of the piece to be cast. By utilizing a high pressure heat exchange cavity and high temperature heat exchange medium, it is possible to conform the configuration of the main heat exchange wall in the high pressure heat exchange cavity to create a temperature profile on the die casting part of the mold substantially conforming to the heat to be removed from various parts of the piece being cast.

The thicker parts of the piece being cast must have more heat transferred therefrom while the thinner parts of the heat being cast require less heat to be removed therefrom. By substantially inversely profiling the thickness of the inside of the main heat exchange of the wall of the high pressure heat exchange cavity to conform to the heat to be removed from various parts of the die casting area, a cooling profile may be obtained which will remove more heat from those parts of the casting requiring more heat loss in solidifying and less heat will be removed from those parts of the casting requiring less heat loss to solidify.

Another difficulty with elongated tubular heat transfer conduits of conventional molds is that the continual passage of water through these conduits leads to the build up of slime or scaling on the sides of the walls of the conduit. This problem may be alleviated somewhat by conditioning or treating the cooling water prior to use. Scaling or slime reduces normal heat transfer between the water and the mold and causes uneven distribution of heat in the mold. The mold must be continually treated to remove slime or scale to maintain satisfactory heat transfer. With a pressurized heat exchange medium such as for instance, water, only sufficient water needs to be added to the heat exchange cavity to replace the steam driven off by the heat exchange occurring as a result of each shot of metal into the die cavity. As a result, sliming or scaling does not occur and the above problem does not exist within the pressurized heat exchange cavity.

The above and other features will be understood from the following disclosure and accompanying drawings wherein.

Figure 1:
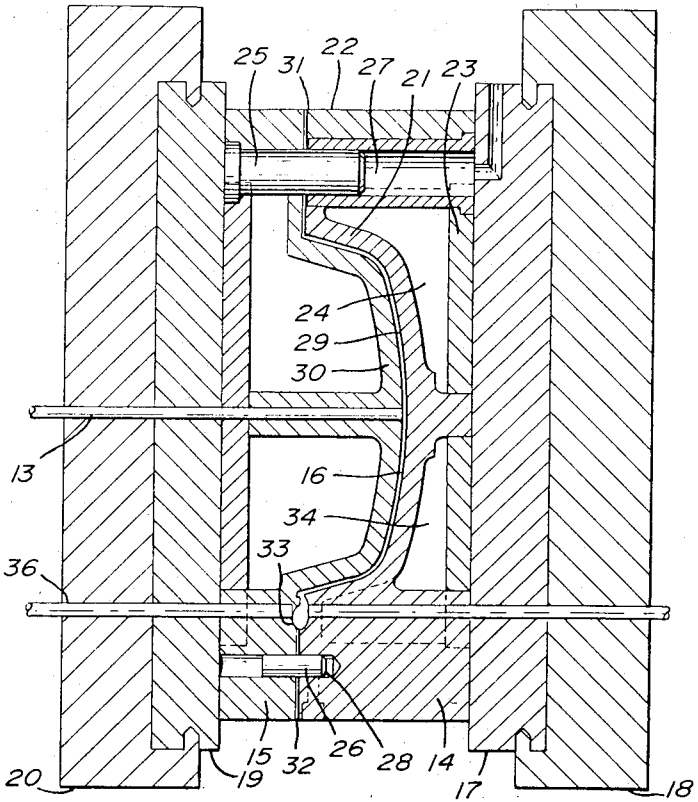
FIG. 1 is a cross-sectional view through half of the permanent mold.

Referring to FIG. 1, there is shown a mold half 1 comprised of a front wall 2, side walls 3 and a backing member 4. The backing member 4 is fastened to the bottom of the side walls 3 by bolts 5. A thin high pressure gasket 6 capable of withstanding high temperatures and high pressures is placed between the bottom of side walls 3 and backing member 4 before the bolts 5 are securely fastened. A high pressure heat exchange cavity 7 is formed between the front wall 2, side walls 3 and the backing member 4. An inlet valve 8 is provided in the side wall 3 to add fluid to the high pressure heat exchange cavity 7 when required. An pressure controlled outlet vent 9 is provided in side wall 3 to remove gas from the high pressure heat exchange cavity 7 after each casting sequence. The front wall 2 includes a die casting area 10 which receives the hot casting liquid. The central part of die casting area 10 forms part of the die cavity in which the cast article is formed. The shape of front wall 2 and die casting area 10 will vary from mold to mold reflecting the shape of the article being cast. The thin wall 11 between the die casting area 10 and the high pressure heat exchange cavity 7 may be as thin as 0.3 inches in thickness depending upon the size and configuration of the part being cast and correspondingly the heat to be removed from any part of the die casting area 10. For example, the thickness of the wall 11 may range from 0.33 to 0.50 inches. In the mold half 1, shown in FIG. 1, a column 12 is formed through the high pressure heat exchange cavity 7 to provide additional support to the front wall 2. An ejector pin 13 runs through the column 12.

Figure 2:
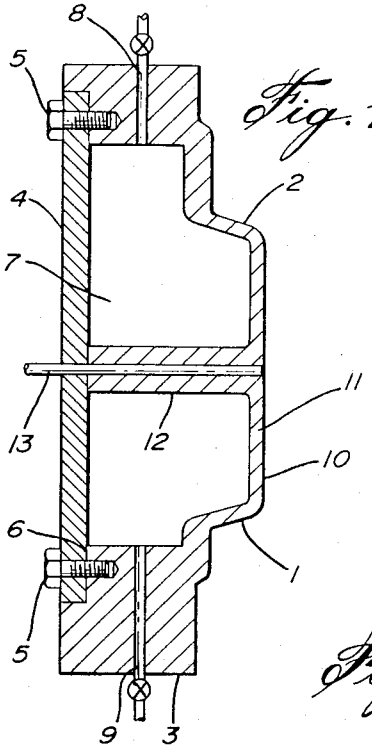
FIG. 2 is a cross-sectional view through the permanent mold including means for retaining the mold halves in line.

Referring to FIG. 2, there are shown two mold halves 14 and 15 in closed position forming die cavity 16. Mold half 14 is fastened to a block 17 which is fastened to one of the platens 18 of the die casting machine which will move mold half 14 towards, closed on or away from mold half 15. Similarly mold half 15 is fastened to block 19 which is fastened to the other platen 20 of the die casting machine which will move mold half 15 towards, closed on or away from mold half 14. Mold half 14 is comprised of front wall 21, side walls 22 and backing member 23. High pressure heat exchange cavity 24 is formed between front wall 21, side walls 22 and backing member 23. Mold half 15 includes two or more guidepins 25 and 26 which are retained within bushings 27 and 28 respectively to maintain mold halves 14 and 15 aligned. When mold halves 14 and 15 are closed as shown in FIG. 2, the die cavity 16 is formed between die cavity areas 29 and 30 of mold halves 14 and 15 respectively.

With the mold halves 14 and 15 in closed position, hot casting metal is introduced at gate 31 and air is vented at vent 32 until die cavity 16 and overflow 33 are filled with hot casting fluid. The hot casting metal is introduced at pressure of up to 2000 p.s.i. and 800° Farenheit for zinc and up to 5000 p.s.i. and 1200° Farenheit for aluminium. When casting with zinc the high pressure heat exchange cavity 24 contains heat exchange fluid 34 under pressure having a temperature up to 450° Farenheit. The safe is true of mold half 14. Alternatively, the pressure employed may be maintained at a point such that the boiling point of the heat exchange medium substantially corresponds to the temperature at which the mold is to be maintained.

With a temperature differential of about 400° Farenheit when zinc is being cast in die cavity 16 and the heat exchange fluid 34 in high pressure heat exchange cavity 24, heat will flow through die cavity area 29 to the heat exchange fluid 34 causing a small portion of the heat exchange fluid to vaporize. The vapor will be bled to the atmosphere through a pressure control outlet vent as indicated in FIG. 1.

When the casting is solidified the mold halves 14 and 15 are moved apart by the platens 18 and 20, the casting is ejected from the die casting cavity by ejecting rods such as 13, 36 and similar rods not indicated in the drawing.

An additional advantage of high pressure heat exchange cavity 24, is that prior to start up of the casting operation, the heat exchange fluid 34 can be heated under pressure and the temperature of each of the half molds can be raised to 450° Farenheit or any other desired temperature before the casting is started. The temperature of the mold can be controlled by a combination of a pressure controls on inlet vent 8 and outlet valve 9 of high pressure heat exchange cavity 7 in combination with an immersion heater in high pressure heat exchange cavity 7.

While the invention has been shown and described in one embodiment, it will be clear to those skilled in the art that the precise details of construction will vary from article to article which is to be cast. The invention is not confined to the precise details of construction which are shown in the drawings but includes those changes and variations which must necessarily be made by those skilled in the art in preparing permanent metal molds incorporating the teachings of this invention, without departing from the spirit of the invention, or exceeding the scope of claims.

What is claimed is:

1. A die casting metal mold half for use in high pressure die casting comprising a front wall adapted to form a portion of a die cavity and incorporating a die casting area, side walls extending rearwardly from the front wall, a backing member, and means to fasten said backing member to said side walls, said front wall, side walls and backing member forming a high pressure heat exchange cavity, means for introducing heat exchange fluid under pressure into said high pressure heat exchange cavity and means for releasing fluid under pressure from said high pressure heat exchange cavity.

2. The die casting metal mold half of claim 1 in which the thickness of the front wall in the die casting area ranges between 0.33 and 0.50 of an inch.

3. The die casting metal mold half of claim 2 in which the thickness of the front wall is substantially less in both the die casting area of the front wall and in the opposed portion of the high pressure heat exchange cavity than in the remainder of the front wall.

4. The die casting metal mold half of claim 1 further including a heat exchange medium and whereby the pressure in the high pressure heat exchange cavity is maintained at a point such that the boiling point of the heat exchange medium substantially corresponds to the temperature at which the mold is to be maintained.

5. The die casting metal mold half of claim 1 further including a heat exchange medium and wherein the pressure in the high pressure heat exchange cavity is maintained at a point such that the boiling point of the heat exchange medium is between 270° and 500° Farenheit.

6. The die casting metal mold half of claim 1 or 3 in which the backing member is fastened to the side walls by a series of bolts.

7. The die casting metal mold half of claim 1 in which one or more hollow posts incorporating ejector pins extend through the high pressure heat exchange cavity.

* * * * *